United States Patent [19]

Katsaros

[11] Patent Number: 4,715,200

[45] Date of Patent: Dec. 29, 1987

[54] LOCKING DEVICE FOR A DOOR LOCK

[76] Inventor: James Katsaros, 616 S. Normandie Ave., Apt. 1303, Los Angeles, Calif. 90005

[21] Appl. No.: 16,676

[22] Filed: Feb. 18, 1987

[51] Int. Cl.[4] ..... E05B 13/08

[52] U.S. Cl. ..... 70/211; 70/416

[58] Field of Search ..... 70/416, 210, 211, 429, 70/430, 1.5, 333 R, 333 A, 417, 19; 292/258, 289, 291, 293, 294, 339, 288

[56] References Cited

U.S. PATENT DOCUMENTS

| | | | |
|---|---|---|---|
| 591,177 | 10/1897 | Palmer | 70/430 |
| 1,047,058 | 12/1912 | Howard | 70/430 |
| 1,082,427 | 12/1913 | Klespies | 70/430 |
| 1,328,186 | 1/1920 | Nied | 70/211 |
| 1,636,392 | 7/1927 | Stubbs | 70/430 |
| 2,161,673 | 6/1939 | Hammond | 292/294 |
| 2,463,195 | 3/1949 | Mungan | 70/416 |
| 2,774,622 | 12/1956 | Priebe | 292/339 |
| 3,263,462 | 8/1966 | Suroff et al. | 70/211 |
| 3,585,827 | 6/1971 | Dominguez | 70/416 |
| 3,724,246 | 4/1973 | Katsaros | 70/211 X |
| 3,748,882 | 7/1973 | Dusault et al. | 70/416 |
| 3,927,544 | 12/1975 | Klein | 70/416 |
| 4,657,293 | 4/1987 | Bell | 292/339 X |

FOREIGN PATENT DOCUMENTS

| | | | |
|---|---|---|---|
| 94655 | 10/1923 | Austria | 70/211 |
| 343216 | 10/1921 | Fed. Rep. of Germany | 70/429 |
| 435831 | 10/1926 | Fed. Rep. of Germany | 70/430 |
| 933108 | 9/1955 | Fed. Rep. of Germany | 70/429 |
| 425848 | 6/1911 | France | 70/430 |
| 665769 | 1/1952 | United Kingdom | 70/416 |

*Primary Examiner*—Lloyd A. Gall

*Attorney, Agent, or Firm*—Jack C. Munro

[57] ABSTRACT

A locking device to be usable in conjunction with a deadlock type of locking apparatus mounted in conjunction with a door. The locking device of this invention is to be attached in a fixed manner to the handle of the deadlock locking apparatus with there being an elongated bar section that is to abut against the conventional doorknob of the door. Any unauthorized turning of the deadlock handle will be prevented since a deadlock handle is constrained due to the elongated bar portion abutting against the doorknob. The locking device of this invention includes a bracket section which is to be movable to accommodate to different positions of deadlock handles.

2 Claims, 4 Drawing Figures

LOCKING DEVICE FOR A DOOR LOCK

Background of the Invention

The field of this invention relates to locking devices and more particularly to a locking device which is designed to be used in conjunction with a conventional door and doorknob which is to be attached to the handle section of a conventional deadlock type of locking mechanism which is mounted on the door spaced from the conventional doorknob.

Doors of houses and buildings normally include a doorknob which is to be grasped and turned to undo a locking mechanism between the door and the door jamb in order to move the door from a closed position to an open position and provide access through the door area. The use of such a doorknob latching mechanism is deemed to be conventional and in exceedingly widespread use. Most commonly, such doorknob mechanisms include a locking mechanism which is to be operated exteriorly of the door with means of a key.

In the past, such doorknob locking mechanisms have been found to be insufficient to prevent unauthorized entry by certain individuals. In the past, in order to make a door more secure it has been common to mount in conjunction with the door a second locking mechanism. A common form of second locking mechanism is what is referred to as a "deadlock" mechanism. Again, this deadlock mechanism is operated by a key exteriorly of the door. Interiorly of the door the deadlock mechanism is connected to a handle which is to be pivoted generally about ninety to one hundred eighty degrees to move the deadlock mechanism from an unlocking position to a locking position.

At times, certain individuals are able to obtain in an unauthorized manner keys which are to permit unauthorized entry through a door even with a deadlock locking mechanism. It has been found that when an occupant of the premises is sleeping, the occupant has a certain piece of mind if a still further locking mechanism can be applied to the door which prevents operation in any way exteriorly of the door.

In the past, there have been many attempts to provide such devices and prevent operations of such a device exteriorly of the door. One such device is shown within the U.S. Pat. No. 3,724,246, issued Apr. 3, 1973, by the present inventor. The structure of the present invention is deemed to began improvement over the locking device of the aforementioned patent.

SUMMARY OF THE INVENTION

The structure of the present invention is to be utilized in conjunction with the conventional doorknob of a door and a secondary locking mechanism of a door. The locking device of this invention is designed to be located on the interior surface of the door. The secondary locking mechanism includes a handle which protrudes from the surface of the door in a manner similar to the protrusion of the conventional doorknob. The handle of the secondary locking mechanism is to be pivoted, generally ninety degrees, from an unlocking position to a locked position. The locking device of this invention includes a bracket section which has an internal compartment. This bracket section is attached to the inner end of an elongated bar with the outer end of the elongated bar being located in a physically abutting relationship with a conventional doorknob. The handle of the secondary locking mechanism is to be located within the internal compartment of the bracket section. A screw threaded clamp is associated with the bracket section and it is to be moved to be tightly fixed with the handle thereby fixing the handle to the bracket section. Any attempt to move the secondary locking mechanism to the unlocked position by a key (which will also pivot the handle) will be prevented because the bar abuts against the doorknob and prevents such movement. This bracket section can be pivoted to numerous positions relative to the bar to accommodate various positions of handles of secondary lock mechanisms.

DETAILED DESCRIPTION OF THE SHOWN EMBODIMENT

Figure 1:
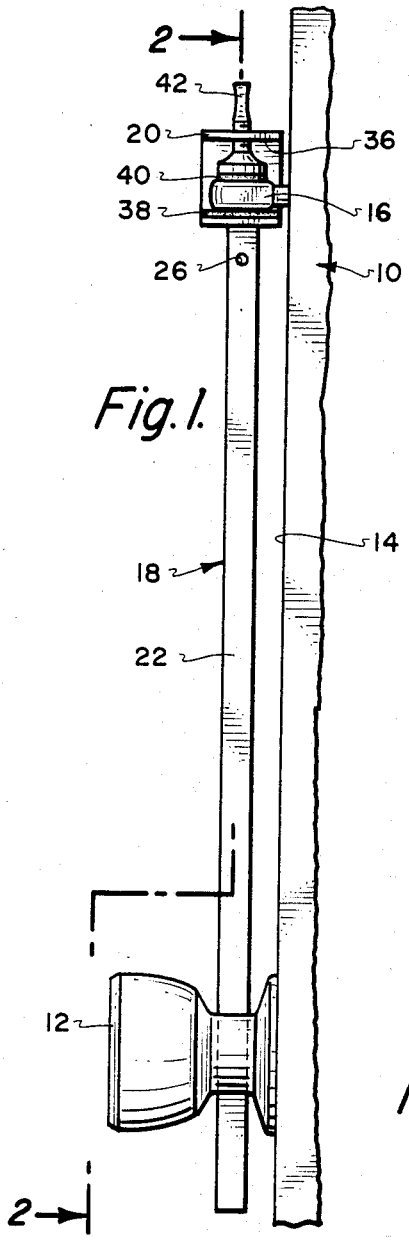
FIG. 1 is a side elevational view of a door upon which has been mounted the locking device of the present invention.

Referring particularly to the drawing, there is shown a side view of a portion of a conventional door 10 in FIG. 1. The door 10 includes a conventional primary or first latching device which is to be operated by the doorknob 12. The doorknob 12 is to be pivoted in order to operate this primary latching device. This primary latching device is to function to hold the door in a closed position and when the doorknob 12 is rotated the door can be opened. The doorknob 12 protrudes fron the interior surface 14 of the door 10.

Also mounted in conjunction with the door 10 is a second latching device (not shown) which is to be operated by a handle 16. The handle 16 is shown to be oblong in shape and protrudes from the interior surface 14 of the door 10. Normally, the handle 16 will be part of what is termed a "deadlock" latching mechanism.

The locking device 18 of this invention is composed generally of a bracket section 20 and elongated bar 22. The function of the bar 22 is that its outer end is to abut against the doorknob 12 as is clearly shown within FIGS. 1 and 2 of the drawing. The inner end of the bar 22 includes a pair of spaced apart threaded holes 24 and 26. A threaded hole 28 is formed within the apex section of the bracket 20. A pair of spaced apart threaded holes 30 and 32 are formed within one of the side walls of the bracket 20.

Figure 2:
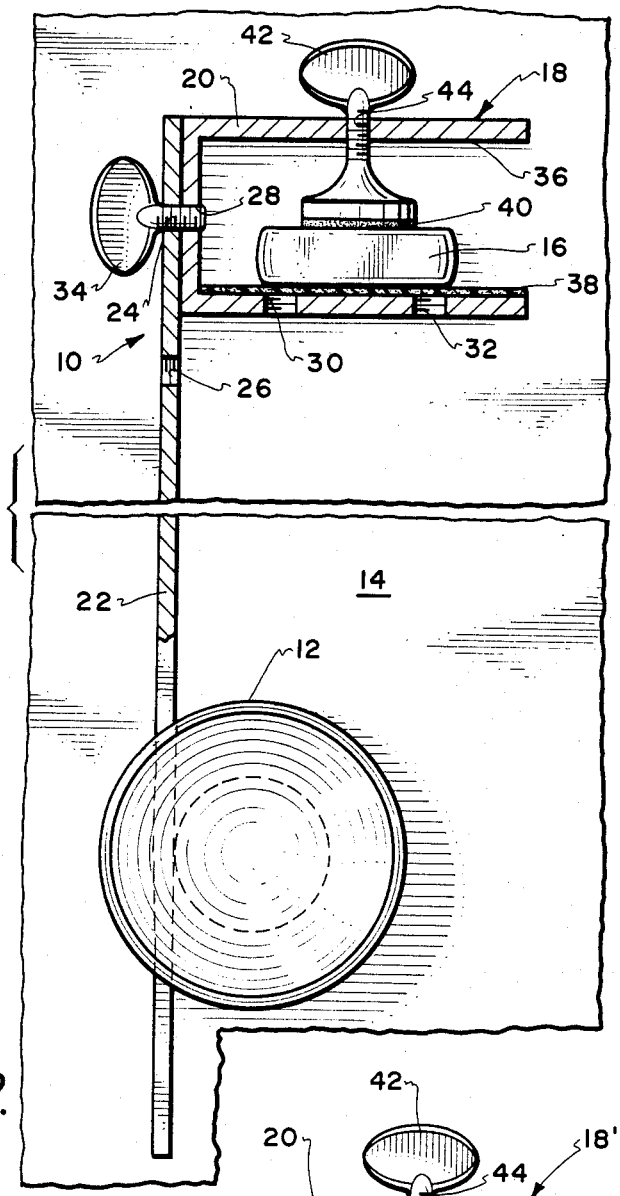
FIG. 2 is a cross-sectional view through the locking device of the present invention taken along 2—2 of FIG. 1.

If the handle 16 is in the position as shown in FIG. 2 of the drawing when in the locked position, the threaded fastener 34 is to connect with holes 24 and 28. The handle 16 is then located within the internal chamber 36 of the bracket 20. Locating of the handle 16 within the internal chamber 36 is of no problem since the bracket 20 is open at its outer end and also the inside and outside side walls of the bracket 20 are open. In order to avoid scratching, or otherwise marring, of the handle 16 there is incorporated on the inside walls surface of the bracket 20 covering holes 30 and 32 a resilient layer 38. A similar resilient layer 40 is formed on the outer surface of a threaded fastener 42.

The threaded fastener 42 threadibly engages with a hole 44 formed within the upper wall surface of the bracket 20. The threaded fastener 42 is to be turned with respect to the bracket 20 so as to tightly bind the handle 16 between the resilient surface 38 and 40. This tightly of securing the handle 16 to the bracket 20 is accomplished at the time the bar 22 is positioned in physical connection with the doorknob 12. This physical connection with the doorknob 12 is such that, if any attempt was made to turn the handle 16 from the locked position to an unlocked position, this turning movement would be prevented because the bar 22 would be pushed against the knob 12. In other words, referring particularly to FIG. 2, the movement of the handle 16 to the unlocked position would be in the counterclockwise direction.

Figure 3:
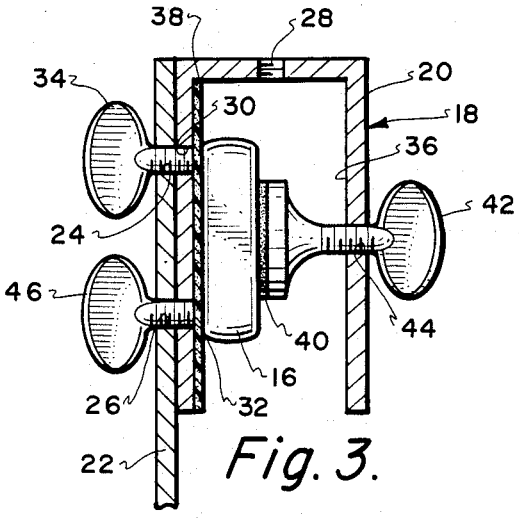
FIG. 3 is a cross-sectional view, similar to a portion of FIG. 2, showing the bracket section of the locking device of this invention in a different position than that of FIG. 2.

If the knob 16 assumes an at-rest locked position other than that shown in FIG. 2, such as shown in Figure 3, it is only necessary for the bracket section 20 to be remounted in a different position. This different position is shown in FIG. 3. In order to accomplish this remounting, it is necessary to remove the threaded fastener 34 from the hole 28. The bracket 20 is then turned ninety degrees with a leg portion of bracket 20 abutting against elongated bar 22. The threaded fastener 34 is then engaged with hole 30. An additional threaded fastener 46 is then connected to the holes 26 and 32 so as to provide a secure positive connection between the bar 22 and the bracket 20. The handle 16 is located in the same manner within the internal compartment 36 and the threaded fastener 42 tightened down against the handle 16 between the mar resisting surfaces 38 and 40.

It is to be noted that when the bracket 20 is engaged, as shown in FIG. 2, that the bracket 20 is capable of a limited amount of pivoting movement about the pivot axis represented by the longitudinal center axis of the threaded fastener 34 with respect to the elongated bar 22. This limited amount of pivoting movement may be found to be of advantage when dealing with a particular configuration of the handle 16 so as to permit a canting position of the bracket 20 relative to the bar 22. During the pivoting movement the apex portion of bracket 20 remains in contact with bar 22.

Figure 4:
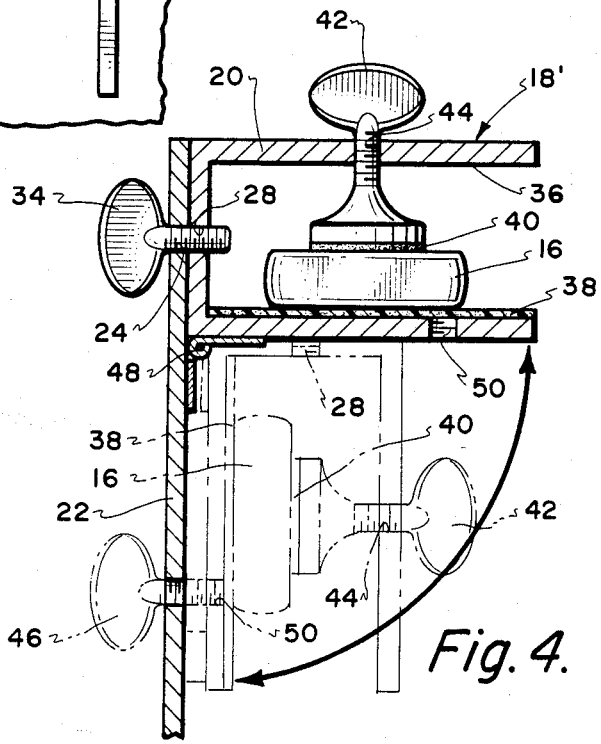
FIG. 4 is a view similar to a portion again of FIG. 2, but of a modified form of locking device of this invention which provides for ease of pivoting of the bracket section relative to the elongated bar of the locking device of this invention.

Referring particularly to FIG. 4 of the drawing, there is shown a modified version 18' of the locking device of this invention. Like numerals have been utilized as to refer to like parts. The only difference of the structure of FIG. 4, is that the bracket 20 is connected by a hinge 48 to the bar 22. With the bracket 20 in the solid line position (first position) shown in FIG. 4 the apex portion of bracket 20 is located against bar 22. The locking device is to be utilized as previously described in relation to FIG. 2. If the threaded fastener 34 is disengaged from the hole 28, the bracket 20 can be pivoted about the hinge 48 to the dotted line position (second position) shown in FIG. 4 which is essentially identical to that shown in FIG. 3. In this dotted line position, a leg portion of bracket 20 lies directly adjacent bar 22. It is to be noted that this dotted line position is ninety degrees displaced from the solid line position. In order to secure the lock in position, the bracket 20, when in the dotted line position shown in FIG. 4, the threaded fastener 46 is utilized to connect with a hole 50 formed within the bracket 20. One of the primary advantages of utilizing the structure of FIG. 4 is that the bracket 20 is always connected to the bar 22 through the hinge 48.

What is claimed is:

1. In combination with a door, said door having a first locking mechanism for latching of said door, a doorknob connected to said first locking mechanism, said doorknob protruding from the surface of said door, a second locking mechansim mounted on said door, said second locking mechanism including a handle, said handle protruding from the surface of said door, said handle being manually movable from a locking position to an unlocking position, a locking device for said door comprising:

a bracket having an internal compartment, said handle to be located within said internal compartment, means mounted on said bracket movable to tightly engage with and be fixed to said handle;

an elongated bar having an inner end and an outer end, said bracket being attached by attaching means to said inner end, said doorknob abutting with said outer end, said bracket being movable relative to said elongated bar to assume various positions, said bracket being fixable to said elongated bar in each said position;

said bracket being pivotable about a pivot axis, said bracket having an apex portion, said elongated bar having an elongated center axis, said pivot axis being substantially perpendicular to said center axis of said elongated bar, during pivoting movement of said bracket relative to said elongated bar said apex portion of said bracket remains in contact with said bar during the entire pivoting movement; and said bracket having a leg portion, said bracket being removable by disconnecting of said attaching means and moving said apex portion from said elongated bar and locating said leg portion against said elongated bar and re-engaging said attaching means.

2. In combination with a door, said door having a first locking mechanism for latching of said door, a doorknob connected to said first locking mechanism, said doorknob protruding from the surface of said door, a second locking mechanism mounted on said door, said second locking mechanism including a handle, said handle protruding from the surface of said door, said handle being manually movable from a locking position to an unlocking position, a locking device for said door comprising:

a bracket having an internal compartment, said handle to be located within said internal compartment, means mounted on said bracket movable to tightly engage with and be fixed to said handle;

an elongated bar having an inner end and an outer end, said bracket being attached by attaching means to said inner end, said doorknob abutting with said outer end, said bracket being movable relative to said elongated bar to assume various positions, said bracket being fixable to said elongated bar in each said position: to receive said handle therein and said various positions being two in number comprising a first position and a second position, said bracket being hingedly movable relative to said elongated bar so that an apex portion of said bracket, when in said first position, is movable to a ninety degree displaced position causing a leg portion of said bracket to be moved directly adjacent said elongated bar thereby occupying said second position.

* * * * *